US005855622A

United States Patent [19]

Takeuchi

[11] Patent Number: 5,855,622

[45] Date of Patent: Jan. 5, 1999

[54] HYDROGEN PEROXIDE-CONTAINING BLEACH LIQUOR AND BLEACHING METHOD THEREBY

[75] Inventor: Hideo Takeuchi, Kanagawa, Japan

[73] Assignee: Clariant International Ltd., Muttenz, Switzerland

[21] Appl. No.: 959,459

[22] Filed: Oct. 27, 1997

[30] Foreign Application Priority Data

Nov. 5, 1996 [JP] Japan ..... 8-293015

[51] Int. Cl.[6] ..... D06L 3/02; D21C 1/08

[52] U.S. Cl. ..... 8/111; 510/309; 510/367; 510/372; 252/186.25; 252/186.28; 252/186.29; 252/186.41; 252/186.43; 162/78

[58] Field of Search ..... 8/111; 510/309, 510/367, 372; 252/186.25, 186.28, 186.29, 186.41, 186.43; 162/78

[56] References Cited

U.S. PATENT DOCUMENTS

| | | | |
|---|---|---|---|
| 2,898,181 | 8/1959 | Dithmar et al. | 8/111 |
| 3,122,417 | 2/1964 | Blaser et al. | 423/272 |
| 3,234,140 | 2/1966 | Irani | 252/186.29 |
| 3,860,391 | 1/1975 | Kling et al. | 8/111 |
| 4,130,501 | 12/1978 | Lutz et al. | 252/186.43 |

*Primary Examiner*—Alan Diamond
*Attorney, Agent, or Firm*—Foley & Lardner

[57] ABSTRACT

A hydrogen peroxide-containing bleach liquor containing one or more compounds selected from organic phosphonic acids and their salts; and a water-soluble alkylamide. A bleaching method comprising using this bleach liquor or this bleach liquor deprived of the water-soluble alkylamide; and performing bleaching with the bleach liquor set at pH 10.0 to 10.7 and heated at 80° to 130° C. (110° to 130° C. in the absence of the alkylamide). The hydrogen peroxide-containing bleach liquor achieves an excellent bleaching effect without using a silicic acid-derived substance which causes a silicate-induced trouble. The bleaching method achieves an unsurpassed bleaching effect by use of the bleach liquor at a temperature in a broad range of 80° to 130° C. under lower alkaline conditions while curtailing the diminution of the physical properties of fibers to be bleached, whether cotton or synthetic fibers.

16 Claims, No Drawings

HYDROGEN PEROXIDE-CONTAINING BLEACH LIQUOR AND BLEACHING METHOD THEREBY

BACKGROUND OF THE INVENTION

1. Field of the Invention

The present invention relates to a hydrogen peroxide-containing bleach liquor achieving a potent bleaching effect without containing silicates, and a bleaching method using the bleach liquor. The bleach liquor and the bleaching method can be utilized mainly in scouring and bleaching steps in the textile industry. They are also applicable to bleaching steps in the field of industries, including a bleaching step in the linen industry and a pulp bleaching step in the paper industry.

2. Description of the Related Art

Scouring and bleaching with hydrogen peroxide have found increasing use in recent years because these technologies are cost-effective, give off no odors, and cause no environmental pollution.

To raise the speed of bleaching with hydrogen peroxide, supply of heat is well known to be an important factor. A commercially available aqueous solution of hydrogen peroxide, however, decomposes at temperatures in excess of 60° C., losing active oxygen. Thus, a substance which enhances the heat stability of hydrogen peroxide and imparts a better bleach is added to the bleach liquor. Known examples of this substance are a system containing both sodium silicate and magnesium ions, aminopolycarboxylic acids, and protein derivatives.

The sodium silicate-Mg ions system contributes to the stabilization and activation of hydrogen peroxide at high temperatures, attaining an excellent bleaching effect. The resulting water-insoluble silicate, however, develops scale, which becomes the cause of a silicate-associated trouble such as a stain on the bleaching apparatus or deposits on an article to be bleached. For instance, the article to be bleached is stiffened by the deposition of the silicate scale, thus damaging the fibers and diminishing their physical properties. Discoloration may also occur. The finished product may be devaluated from these causes.

Aminopolycarboxylic acids or protein derivatives contribute to the stability of hydrogen peroxide at high temperatures, but impart a lower degree of bleach, because their activating effect is low.

The appropriate pH of a bleach liquor in the fiber industry is said to be 11. At a pH above 11, hydrogen peroxide self-decomposes markedly, lowering the degree of bleach, and the increased alkalinity decreases the strength of a cotton fabric. At a pH below 11, the activity of hydrogen peroxide decreases, and the degree of bleach lowers. Bleaching of cotton or synthetic fibers, therefore, use the appropriate pH of 11 at a bleaching temperature of 100° C. or higher. Animal fibers such as wool or silk, on the other hand, may be damaged by an alkali or deteriorated under heat, so that they are bleached at pH 9 to 10 and at a temperature of 80° to 90° C. at the sacrifice of the bleaching power. Under this situation, the bleaching potential of hydrogen peroxide is not fulfilled.

SUMMARY OF THE INVENTION

It is the object of the present invention to provide a hydrogen peroxide-containing bleach liquor achieving an excellent bleaching effect without using a silicic acid-derived substance, a causative agent for the silicate-induced trouble, and a bleaching method which achieves an unsurpassed bleaching effect by use of the bleach liquor at a temperature in a broad range of 80° to 130° C. under lower alkaline conditions than in the prior art while curtailing the diminution of the physical properties of fibers to be bleached, whether cotton or synthetic fibers, as compared with the prior art.

The present invention relates to a hydrogen peroxide-containing bleach liquor containing one or more compounds selected from organic phosphonic acids and their salts; and a water-soluble alkylamide. Preferably, this bleach liquor is an aqueous solution containing 0.5 to 2% of hydrogen peroxide, 50 to 1,500 ppm of an organic phosphonic acid and/or its salt, and up to 1,500 ppm of a water-soluble alkylamide, all proportions based on the total amount of the bleach liquor.

The advantageous organic phosphonic acid and its salt used in the invention are one or more compounds selected from 1-hydroxyethylidene-1,1-diphosphonic acids and their salts, both expressed by the formula (1)

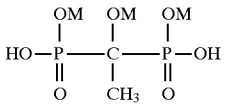

(1)

where M's each represent, independently of each other, a hydrogen atom, an alkali metal, preferably sodium, or an alkali earth metal, preferably magnesium, and/or one or more compounds selected from aminotri(methylene)phosphonic acids and their salts, both expressed by the formula (2)

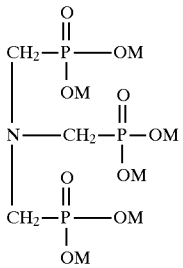

(2)

where M's each represent, independently of each other, a hydrogen atom, an alkali metal, preferably sodium, or an alkali earth metal, preferably magnesium.

Preferred examples of the organic phosphonic acid are ethylenediaminetetra(methylenephosphonic acid), and diethylenetriamineaminopenta(methylenephosphonic acid). When a mixture of the 1-hydroxyethylidene-1,1-diphosphonic acid and its salt, both expressed by the formula (1), and the aminotri(methylene)phosphonic acid and its salt, both expressed by the formula (2) is used as the organic phosphonic acid and its salt, the weight ratio of the compound of the formula (1) to the compound of the formula (2) is preferably 7:3 to 3:7, more preferably 6:4 to 4:6.

The advantageous water-soluble alkylamide used in the present invention is a compound of the formula (3)

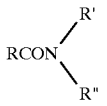

(3)

where R represents a straight-chain or branched $C_1$ to $C_{10}$ alkyl group, and R' and R" each represent, independently of each other, a hydrogen atom, a straight-chain or branched $C_1$ to $C_3$ alkyl group, or —$CH_2CH_2OH$, preferably, acetamide, dimethylacetamide, octylic acid diethanolamide, or isononanoic acid diethanolamide, or a mixture of these compounds.

The inventor of the present invention has further found that when the above-described bleach liquor is used, fibers, whether cotton or synthetic fibers, can be bleached very effectively at a temperature in a broad range of from 80° to 130° C. and at pH 10.0 to 10.7, a relatively low pH which is favorable for the material to be bleached.

The present invention, therefore, also relates to a bleaching method which comprises using the aforementioned hydrogen peroxide-containing bleach liquor, and performing bleaching with the bleach liquor set at pH 10.0 to 10.7 and heated at 80° to 130° C.

Bleaching at a low pH is advantageous in that the material bleached suffers less damage. In this sense, the decrease of pH by up to 1, i.e. from pH 11 to pH 10, in the field of bleaching is very favorable for the material to be bleached. Concretely, the bleaching of silk or hemp is feasible at the optimal pH.

A particularly advantageous embodiment of the method claimed in the present invention is such that the bleach liquor is an aqueous solution containing 0.5 to 2% of hydrogen peroxide, 50 to 1,500 ppm of the organic phosphonic acid and/or its salt, and up to 1,500 ppm of the water-soluble alkylamide. Desirably, the amount of the organic phosphonic acid and/or its salt is 1 to 10 parts by weight based on 100 parts by weight of hydrogen peroxide, and the amount of the water-soluble alkylamide is 0 to 20 parts by weight based on 100 parts by weight of hydrogen peroxide. If the amount of the organic phosphonic acid and/or its salt is less than 1 part by weight based on 100 parts by weight of hydrogen peroxide, the bleaching power will be weak. If its amount is more than 10 parts by weight, on the other hand, the degree of bleach will not rise any more.

The water-soluble alkylamide reacts with hydrogen peroxide, forming a peracid such as peracetic acid. At a higher pH, the amount of the peracid formed increases. However, a lower pH is preferred for the activation of the peracid. According to the present invention, the pH of the bleach liquor is 10.0 to 10.7, preferably 10.2 to 10.5. If the pH of the bleach liquor is lower than 10.0 or higher than 10.7, the bleaching power will be low.

The inventor has also found that even without the use of the water-soluble alkylamide, bleaching at a temperature of 110° to 130° C. and at pH in the above-mentioned specific range can achieve a superb bleaching effect.

That is, the present invention also concerns a bleaching method which comprises using a hydrogen peroxide-containing bleach liquor containing one or more compounds selected from the organic phosphonic acids and/or their salts, and performing bleaching with the bleach liquor set at pH 10.0 to 10.7 and heated at 110° to 130° C. With this method as well, the bleach liquor advantageously contains 0.5 to 2% of hydrogen peroxide, and 50 to 1,500 ppm of the organic phosphonic acid and/or its salt. For the same reason as described earlier, the amount of the organic phosphonic acid and/or its salt is desirably 1 to 10 parts by weight based on 100 parts by weight of hydrogen peroxide. The pH is preferably 10.2 to 10.5, more preferably about 10.3. Since the bleach liquor of the present invention has a buffer action ascribed to the organic phosphonic acid and/or its salt, the adjustment of pH is not difficult. For pH adjustment, sodium hydroxide, sodium carbonate, and the like have been used for bleaching with hydrogen peroxide, and can be used for the bleach liquor of the present invention.

The bleach liquor and bleaching method of the present invention can employ penetrants such as nonionic surfactants or anionic surfactants, or pickup improvers such as water-soluble polymers, the agents that have hitherto been used for hydrogen peroxide bleaching.

The bleach liquor of the present invention may further contain organic stabilizers of the non-silicate type in customary use, such as Stabilizer AWN's, Prestogen P's, Rastabil's, Plight W's, and Neorate PLC's, depending on the purpose of use.

PREFERRED EMBODIMENTS OF THE INVENTION

The present invention will now be described in more detail with reference to the following Examples, which in no way limit to this invention.

EXAMPLE 1

In this Example, the components to be added in trace amounts were prepared beforehand as solutions as shown in Table 1. As indicated in Table 2, these solutions were used to prepare bleach liquors, which were made into test solutions for bleaching test. Liquid tea used in the bleaching test was obtained by heating two tea bags in 1,000 ml of tap water for 30 minutes at 90° C.

The bleaching test was performed in the following manner: The test solutions of the formulations indicated in Table 2 were heated in a water bath at 90° C. for 30 minutes, and then allowed to cool down to room temperature. Then, these test solutions were measured for transmittance (T%) at 430 nm by means of a spectrophotometer. The higher the transmittance is, the less deep the color of the tea is.

TABLE 1

Prepared solutions of the components added in trace amounts

| Component | Prepared Solution No. 1 | No. 2 | No. 3 | No. 4 |
|---|---|---|---|---|
| Hoe T 4215*) (%) | 10 | 10 | 10 | 10 |
| Sodium hydroxide (%) | 0.35 | 0.35 | 0.35 | 0.35 |
| Acetamide (%) | — | 10 | — | — |
| Dimethylacetamide (%) | — | | 10 | 10 |
| Isononanoic acid diethanolamide (%) | — | — | — | 10 |
| Purified water | ad 100**) | ad 100**) | ad 100**) | ad 100**) |

Hoe T 4215*): A 1:1 mixture of 1-hydroxyethylidene-1,1-diphosphonic acid and aminotri (methylenephosphpnic acid), a product of Hoechst AC (Germany)

ad 100**): Amount of purified water necessary to make the total amount 100%

TABLE 2

| Formulation for bleaching test solution | Results of bleaching test: Referential Ex. 1 | Referential Ex. 2 | Ex. of present invention 3 | 4 | 5 | 6 | Comparative Ex. 1 | Comparative Ex. 2 |
|---|---|---|---|---|---|---|---|---|
| Aqueous solution of hydrogen peroxide[1]) (parts) | 3 | 3 | 3 | 3 | 3 | 3 | 3 | 3 |
| Sodium hydroxide[2]) (parts) | 3 | 10 | 3 | 3 | 3 | 10 | 3 | 10 |
| Prepared solution 1 (parts) | 0.2 | 0.2 | — | — | — | — | — | — |
| Prepared solution 2 (parts) | — | — | 0.2 | — | — | — | — | — |
| Prepared solution 3 (parts) | — | — | — | 0.2 | — | — | — | — |
| Prepared solution 4 (parts) | — | — | — | — | 0.2 | 0.2 | — | — |
| Liquid tea (parts) | 80 | 80 | 80 | 80 | 80 | 80 | 80 | 80 |
| pH of bleach liquor | 10.3 | 11.0 | 10.3 | 10.3 | 10.4 | 11.4 | 10.3 | 11.0 |
| Transmittance (T %) | 56.8 | 62.7 | 73.6 | 77.0 | 79.7 | 70.3 | 54.6 | 57.0 |

[1])The concentration of hydrogen peroxide is 30% by weight.
[2])The concentration of sodium hydroxide is 3% by weight.

In the bleaching test with the bleach liquor heated at 90° C., Referential Examples 1 and 2, the systems containing the organic phosphonic acid in addition to hydrogen peroxide and sodium hydroxide, showed little improvement in the bleaching power over Comparative Examples 1 and 2, the systems containing only hydrogen peroxide and sodium hydroxide. Examples 3, 4, 5 and 6 of the present invention containing the water-soluble alkylamide in addition to the organic phosphonic acid, hydrogen peroxide and sodium hydroxide, on the other hand, exhibited a strong bleaching power. Examples 3, 4 and 5, the systems with the bleach liquor adjusted to about pH 10.3, showed a markedly high bleaching power, a better outcome than Example 6, the system with the bleach liquor adjusted to pH 11.4.

EXAMPLE 2

In this Example, the components to be added in trace amounts were prepared beforehand as solutions as shown in Table 3. As indicated in Table 4, these solutions were used to prepare bleach liquors, which were made into test solutions for bleaching test. Liquid tea used in the bleaching test was obtained by heating two tea bags in 1,000 ml of tap water for 30 minutes at 90° C.

The bleaching test was performed in the following manner: The test solutions of the formulations indicated in Table 4 were heated in an oil bath at 125° C. for 30 minutes by blowing steam into the oil bath, and then allowed to cool down to room temperature. Then, these test solutions were measured for transmittance (T%) at 430 nm by means of a spectrophotometer. The higher the transmittance is, the less deep the color of the tea is.

TABLE 3

| Prepared solutions of the components added in trace amounts | Prepared Solution No. 5 | No. 6 | No. 7 | No. 8 |
|---|---|---|---|---|
| Hoe T 4215*) (%) | 10.0 | 10.0 | 10.0 | 10.0 |
| Sodium hydroxide (%) | 0.35 | 0.35 | — | 0.35 |
| Magnesium oxide (%) | — | | 0.10 | |
| Dimethylacetamide (%) | 5.0 | 10.0 | 5.0 | — |
| Purified water | ad 10.0**) | ad 100**) | ad 100**) | ad 100**) |

Hoe T 4215*): A 1:1 mixture of 1-hydroxyethylidene-1,1-diphosphonic acid and aminotri (methylenephosphonic acid), a product to Hoechst AG (Germany)
ad 100**): Amount to purified water necessary to make the total amount 100%

TABLE 4

Results of bleaching test
(Amounts of the components in the formulation for bleaching test solution: Parts)

| Formulation for bleaching test solution | Referential Ex. or Ex. of present invention 7 | 8 | 9 | 10 | 11 | 12 | 13 | 14 | Comparative Ex. 3 | 4 |
|---|---|---|---|---|---|---|---|---|---|---|
| Aqueous solution of hydrogen peroxide[1]) | 3 | 3 | 3 | 3 | 3 | 3 | 3 | 3 | 3 | 3 |
| Sodium hydroxide[2]) | 3 | 10 | 3 | 10 | 3 | 10 | 3 | 10 | 3 | 10 |
| Prepared solution 5 | 0.2 | 0.2 | — | — | — | — | — | — | — | — |
| Prepared solution 6 | — | — | 0.2 | 0.2 | — | — | — | — | — | — |

TABLE 4-continued

Results of bleaching test
(Amounts of the components in the formulation for bleaching test solution: Parts)

| Formulation for bleaching test | Referential Ex. or Ex. of present invention | | | | | | | | Comparative Ex. | |
|---|---|---|---|---|---|---|---|---|---|---|
| solution | 7 | 8 | 9 | 10 | 11 | 12 | 13 | 14 | 3 | 4 |
| Prepared solution 7 | — | — | — | — | 0.2 | 0.2 | — | — | — | — |
| Prepared solution 8 | — | — | — | — | — | — | 0.2 | 0.2 | | |
| Liquid tea | 80 | 80 | 80 | 80 | 80 | 80 | 80 | 80 | 80 | 80 |
| pH of bleach liquor | 10.4 | 11.0 | 10.4 | 11.0 | 40.3 | 11.0 | 10.3 | 11.0 | 10.3 | 11.0 |
| Transmittance (T %) | 82.2 | 65.7 | 83.3 | 66.7 | 85.5 | 66.2 | 84.0 | 67.8 | 65.3 | 59.8 |

[1)]The concentration of hydrogen peroxide is 30% by weight.
[2)]The concentration of sodium hydroxide is 3% by weight.

Of the Examples shown in Table 4, Examples 7, 9, 11 and 13 are Examples of the present invention, while Examples 8, 10, 12 and 14 are Referential Examples.

In the bleaching test with the bleach liquor heated at 125° C., the system containing the organic phosphonic acid in addition to hydrogen peroxide and sodium hydroxide, had a weak bleaching power when the pH of the bleach liquor was 11.0 (Example 14), but had a strong bleaching power when the pH of the bleach liquor was 10.3 (Example 13), in comparison with Comparative Examples 3 and 4, the systems containing only hydrogen peroxide and sodium hydroxide. The systems containing the water-soluble alkylamide in addition to the organic phosphonic acid, hydrogen peroxide and sodium hydroxide, on the other hand, exhibited a slight improvement in bleaching power over the Comparative Examples when the pH of the bleach liquor was 11.0 (Referential Examples 8, 10 and 12). The systems with the bleach liquor adjusted to about pH 10.3 (Examples 7, 9 and 11 of the present invention), by contrast, showed a high bleaching power.

What is claimed is:

1. A hydrogen peroxide-containing bleach liquor containing, based on the total amount of the bleach liquor, 0.5 to 2% of hydrogen peroxide, 50 to 1,500 ppm of an organic phosphoric acid and/or its salt, and a water-soluble alkylamide present at a concentration of 1,500 ppm or less.

2. A bleaching method for bleaching textile and pulp comprising using the hydrogen peroxide-containing bleach liquor of claim 1, and performing bleaching with the bleach liquor set at pH 10.2 to 10.5 and heated at 80° to 130° C.

3. The hydrogen peroxide-containing bleach liquor of claim 1, wherein the organic phosphonic acid and its salt are one or more compounds of the formula (1)

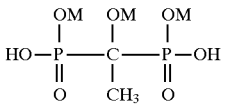

(1)

where M's each represent, independently of each other, a hydrogen atom, an alkali metal, or an alkali earth metal, and/or one or more compounds of the formula (2)

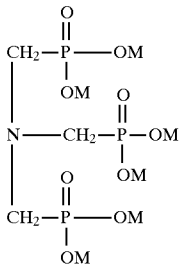

(2)

where M's each represent, independently of each other, a hydrogen atom, an alkali metal, or an alkali earth metal.

4. A bleaching method for bleaching textile and pulp comprising using the hydrogen peroxide-containing bleach liquor of claim 3, and performing bleaching with the bleach liquor set at pH 10.2 to 10.5 and heated at 80° to 130° C.

5. The hydrogen peroxide-containing bleach liquor of claim 1, wherein the water-soluble alkylamide is one or more compounds of the formula (3)

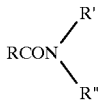

(3)

where R represents a straight-chain or branched C to $C_{10}$ alkyl group, and R' and R" each represent, independently of each other, a hydrogen atom, a straight-chain or branched $C_1$ to $C_3$ alkyl group, or —$CH_2CH_2OH$.

6. A bleaching method for bleaching textile and pulp comprising using the hydrogen peroxide-containing bleach liquor of claim 5, and performing bleaching with the bleach liquor set at pH 10.2 to 10.5 and heated at 80° to 130° C.

7. The hydrogen peroxide-containing bleach liquor of claim 3, wherein the water-soluble alkylamide is one or more compounds of the formula (3)

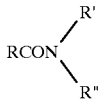

(3)

where R represents a straight-chain or branched $C_1$ to $C_{10}$ alkyl group, and R' and R" each represent, independently of each other, a hydrogen atom, a straight-chain or branched $C_1$ to $C_3$ alkyl group, or —$CH_2CH_2OH$.

8. A bleaching method for bleaching textile and pulp comprising using the hydrogen peroxide-containing bleach liquor of claim 7, and performing bleaching with the bleach liquor set at pH 10.2 to 10.5 and heated at 80° to 130° C.

9. A bleaching method for bleaching textile and pulp comprising using the hydrogen peroxide-containing bleach liquor of claim 1, and performing bleaching with the bleach liquor set at pH 10.0 to 10.7 and heated at 80° to 130° C.

10. A bleaching method for bleaching textile and pulp comprising using the hydrogen peroxide-containing bleach liquor of claim 3, and performing bleaching with the bleach liquor set at pH 10.0 to 10.7 and heated at 80° to 130° C.

11. A bleaching method for bleaching textile and pulp comprising using the hydrogen peroxide-containing bleach liquor of claim 5, and performing bleaching with the bleach liquor set at pH 10.0 to 10.7 and heated at 80° to 130° C.

12. A bleaching method for bleaching textile and pulp comprising using the hydrogen peroxide-containing bleach liquor of claim 7, and performing bleaching with the bleach liquor set at pH 10.0 to 10.7 and heated at 80° to 130° C.

13. A bleaching method for bleaching textile and pulp comprising using the hydrogen peroxide-containing bleach liquor containing one or more compounds selected from organic phosphonic acids and their salts; and a water-soluble alkylamide, and performing bleaching with the bleach liquor set at pH 10.0 to 10.7 and heated at 80° to 130° C.

14. A bleaching method for bleaching textile and pulp comprising using the hydrogen peroxide-containing bleach liquor containing one or more compounds selected from organic phosphonic acids and their salts; and a water-soluble alkylamide, wherein the organic phosphonic acid and its salt are one or more compounds of the formula (1)

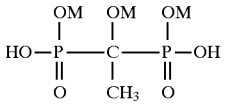

(1)

where M's each represent independently of each other, a hydrogen atom, an alkali metal, or an alkali earth metal, and/or one or more compounds of the formula (2)

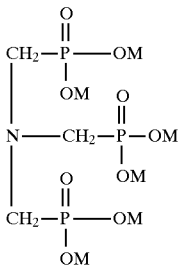

(2)

where M's each represent, independently of each other, a hydrogen atom, an alkali metal, or an alkali earth metal, and performing bleaching with the bleach liquor set at pH 10.0 to 10.7 and heated at 80° to 130° C.

15. A bleaching method for bleaching textile and pulp comprising using the hydrogen peroxide-containing bleach liquor containing one or more compounds selected from organic phosphonic acids and their salts; and a water-soluble alkylamide, wherein the water-soluble alkylamide is one or more compounds of the formula (3)

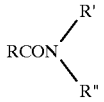

(3)

where R represents a straight-chain or branched $C_1$ to $C_{10}$ alkyl group, and R' and R" each represent, independently or each other, a hydrogen atom, a straight-chain or branched $C_1$ to $C_3$ alkyl group, or —$CH_2CH_2OH$, and performing bleaching with the bleach liquor set at pH 10.0 to 10.7 and heated at 80° to 130° C.

16. A bleaching method for bleaching textile and pulp comprising using the hydrogen peroxide-containing bleach liquor containing one or more compounds selected from organic phosphonic acids and their salts; and a water-soluble alkylamide, wherein the organic phosphonic acid and its salt are one or more compounds of the formula (1)

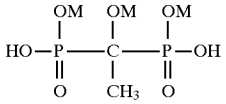

(1)

where M's each represent independently of each other, a hydrogen atom, an alkali metal, or an alkali earth metal, and/or one or more compounds of the formula (2)

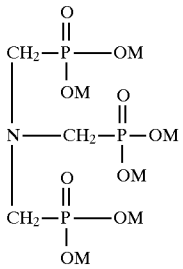

(2)

where M's each represent, independently of each other, a hydrogen atom, an alkali metal, or an alkali earth metal, and wherein the water-soluble alkylamide is one or more compounds of the formula (3)

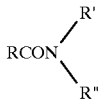

(3)

where R represents a straight-chain or branched $C_1$ to $C_{10}$ alkyl group, and R' and R" each represent, independently or each other, a hydrogen atom, a straight-chain or branched $C_1$ to $C_3$ alkyl group, or —$CH_2CH_2OH$, and performing bleaching with the bleach liquor set at pH 10.0 to 10.7 and heated at 80° to 130° C.

* * * * *